US006808410B1

(12) United States Patent
Lee

(10) Patent No.: US 6,808,410 B1
(45) Date of Patent: Oct. 26, 2004

(54) CABLE CONNECTOR ASSEMBLY HAVING PULLING MECHANISM

(75) Inventor: George Lee, Irvine, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/652,633

(22) Filed: Aug. 28, 2003

(51) Int. Cl.[7] ..... H01R 13/00
(52) U.S. Cl. ..... 439/484; 439/606
(58) Field of Search ..... 439/483, 484, 439/604, 606

(56) References Cited

U.S. PATENT DOCUMENTS 4,379,361 A 4/1983 Webster et al.
4,586,768 A * 5/1986 Eck ..... 439/160
4,881,911 A * 11/1989 Haddock et al. ..... 439/484
6,074,237 A 6/2000 Lee
6,126,479 A 10/2000 Lee
6,132,241 A 10/2000 Hwang
6,319,049 B1 * 11/2001 Lee ..... 439/484
6,402,552 B1 * 6/2002 Wagner ..... 439/606
6,416,353 B1 * 7/2002 Hwang et al. ..... 439/484
6,416,354 B1 * 7/2002 Lee ..... 439/484
6,428,357 B1 * 8/2002 Dolinshek et al. ..... 439/606
6,500,023 B1 * 12/2002 Duong et al. ..... 439/484
6,585,537 B1 * 7/2003 Lee ..... 439/358
6,736,667 B1 * 5/2004 Wu ..... 439/484

* cited by examiner

*Primary Examiner*—Ross Gushi
(74) *Attorney, Agent, or Firm*—Wei Te Chung

(57) ABSTRACT

A cable connector assembly (1) includes an insulative housing (2) defining a number of passages (27), a number of conductive contacts (3) respectively received in the passages, a cable (5) having a number of conductors (52, 54) respectively electrically connecting with the conductive contacts, a cover (8) partially enclosing the housing, a locking member (6) assembled to the cover, and a pulling member (7). The cover forms a pair of protrusions (80) on opposite sides thereof. The locking member comprises a main body (60) facing to the cover and a pair of arms (62) respectively engaging with the protrusions. The pulling member is sandwiched between the cover and the main body of the locking member for being pulled to disengage the cable connector assembly from a complementary connector.

18 Claims, 7 Drawing Sheets

CABLE CONNECTOR ASSEMBLY HAVING PULLING MECHANISM

BACKGROUND OF THE INVENTION

1. Field of the Invention

The present invention generally relates to a cable connector assembly, and more particularly to a cable connector assembly having a pulling mechanism for un-plugging the cable connector assembly.

2. Description of Related Art

With the miniaturization of the electrical device, the density of electronic components mounted on a panel of a chassis in the electrical device is notably increased. An issue is raised when there is a need to release a cable connector assembly from a mated complementary connector which is mounted on the panel of the electrical device that an operator can only pull the cable of the assembly to unplug the cable connector assembly. Obviously, this may cause wires of the cable divorcing from corresponding contacts of the cable connector, and thus, inevitably influences the signal transmission between the cable connector assembly and the mated complementary connector. To solve this problem, different kinds of pull mechanisms are designed. U.S. Pat. Nos. 4,379,361, 6,126,479 and 6,416,353 each disclose such a pull tab or pull mechanism to disengage the cable connector assembly from the mated complementary connector.

U.S. Pat. No. 4,379,361 discloses a pull tab received in a housing of a cable termination assembly and having a plurality of openings for receiving respective deformed parts of signal conductors of a cable. This kind of pull tab is difficult to assemble to the cable termination assembly and the structure thereof is relatively complex.

U.S. Pat. No. 6,416,353 discloses an IDC (Insulation Displacement Connection) connector assembly which comprises a housing, a cable terminated to contacts received in the housing, a first cover assembled to the housing and the cable, and a second cover assembled to the first cover and the housing and functioning as a pull mechanism for separating the connector assembly from a complementary connector. However, the occupied space of the second cover is relatively large.

U.S. Pat. No. 6,126,479 discloses an IDC connector assembly which comprises an elongated housing containing a plurality of contacts therein, a cable electrically terminated to the contacts, an elongated cover assembled to the housing and the cable, and a flexible pull tab received in a slot defined between longitudinal sides of the cover. However, the elongated cover needs to be high enough to ensure a rigidity thereof and resist a pulling force exerted on the pull tab.

Hence, a cable end connector assembly with an improved pulling member is highly desired to address the problems encountered in the related art.

SUMMARY OF THE INVENTION

An object of the present invention is to provide a cable connector assembly having a pulling mechanism for disengaging the cable connector assembly from a complementary connector conveniently.

In order to achieve the object set forth, a cable connector assembly in accordance with the present invention comprises an insulative housing defining a plurality of passages, a plurality of conductive contacts respectively received in the passages, a cable comprising a plurality of conductors respectively electrically connecting with the conductive contacts, a cover partially enclosing the housing, a locking member assembled to the cover, and a pulling member. The cover forms a pair of protrusions on a pair of sides thereof. The locking member comprises a main body facing to the cover and a pair of arms respectively engaging with the protrusions of the cover. The pulling member is sandwiched between the cover and the main body of the locking member for being pulled to disengage the cable connector assembly from a complementary connector.

Other objects, advantages and novel features of the invention will become more apparent from the following detailed description when taken in conjunction with the accompanying drawings.

DETAILED DESCRIPTION OF THE INVENTION

Reference will now be made in detail to the preferred embodiment of the present invention.

Figure 1:
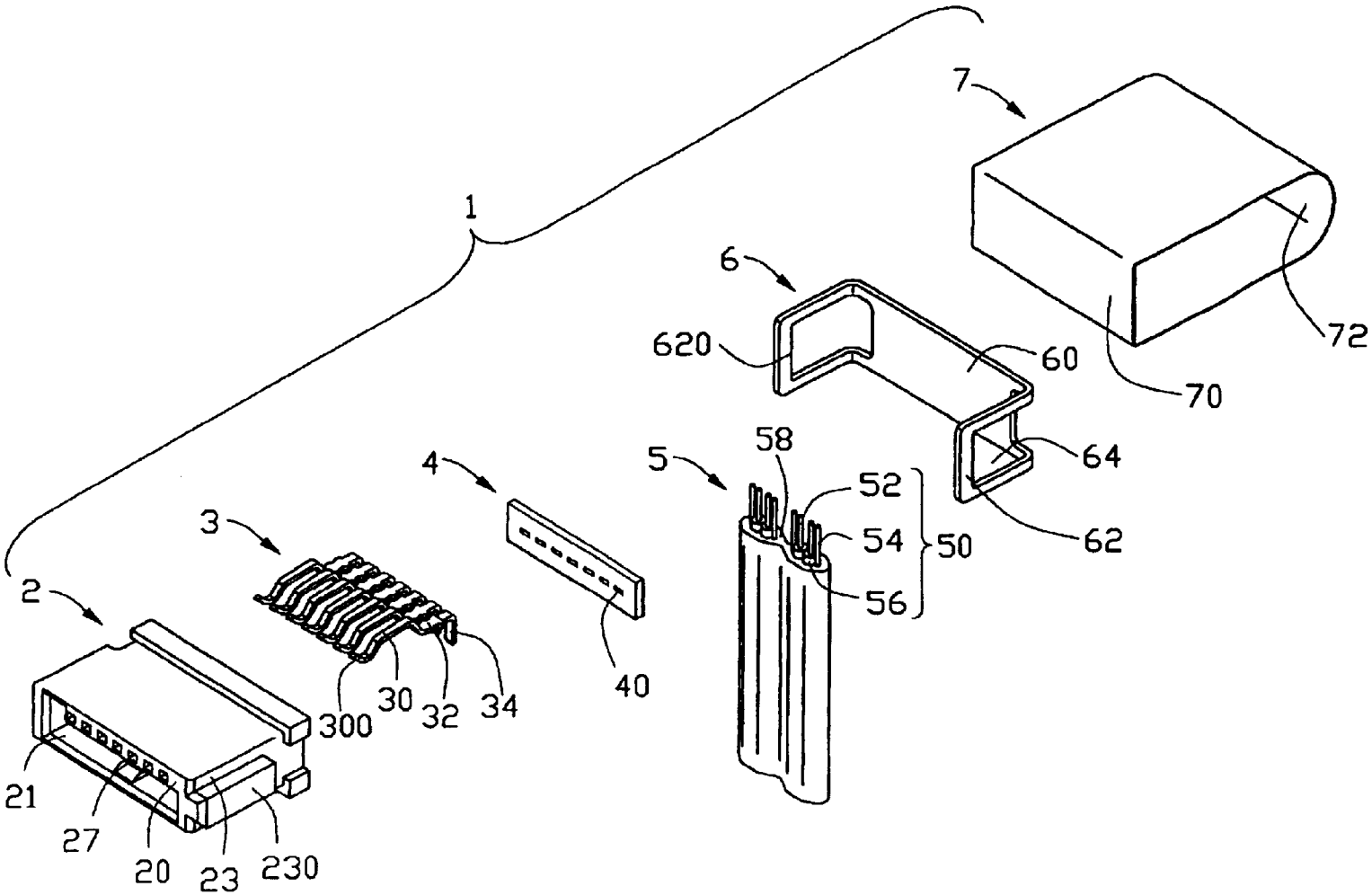
FIG. 1 is an exploded, perspective view of a cable connector assembly in accordance with the present invention.
Figure 2:
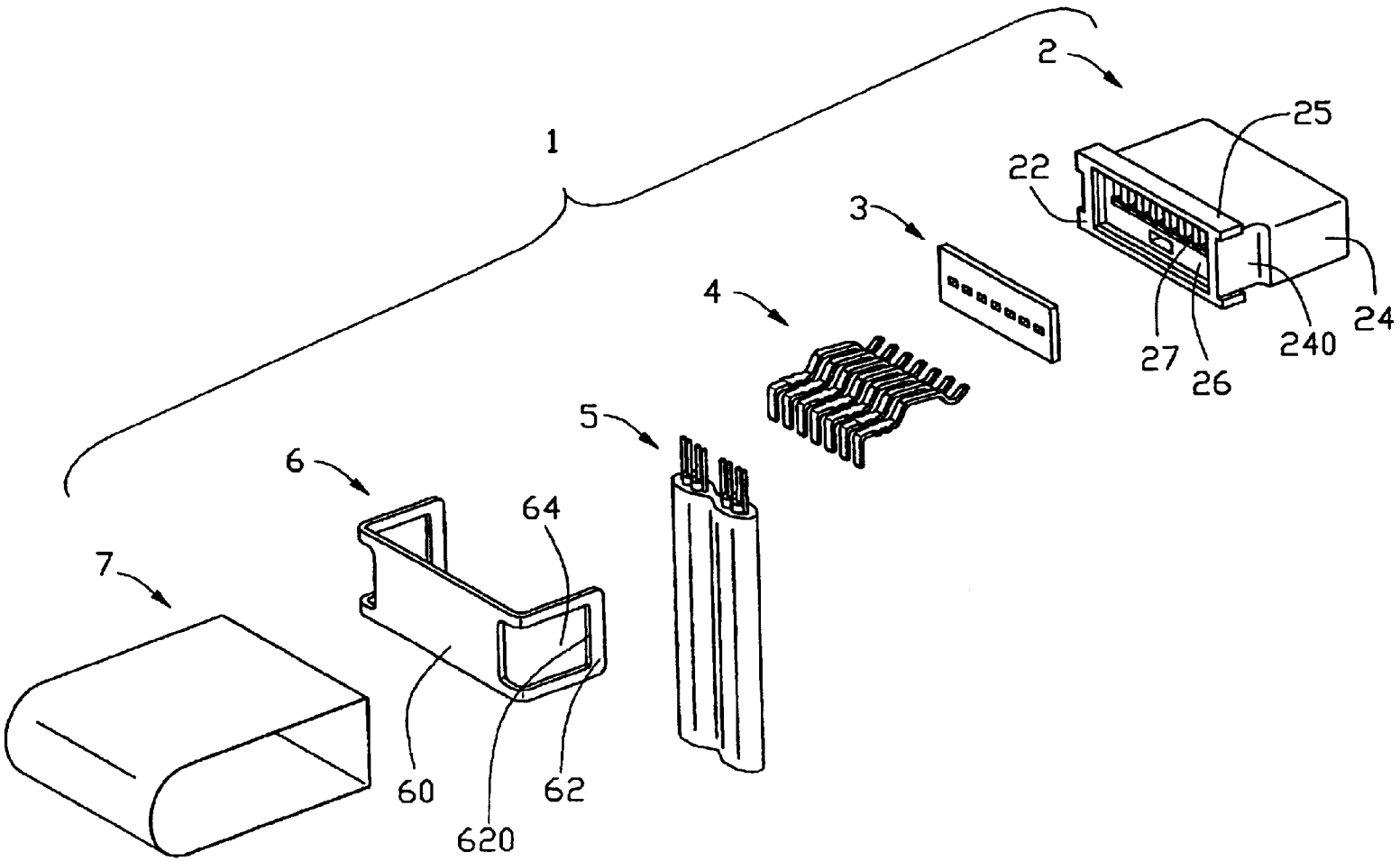
FIG. 2 is a view similar to FIG. 1, but taken from a different aspect.
Figure 3:
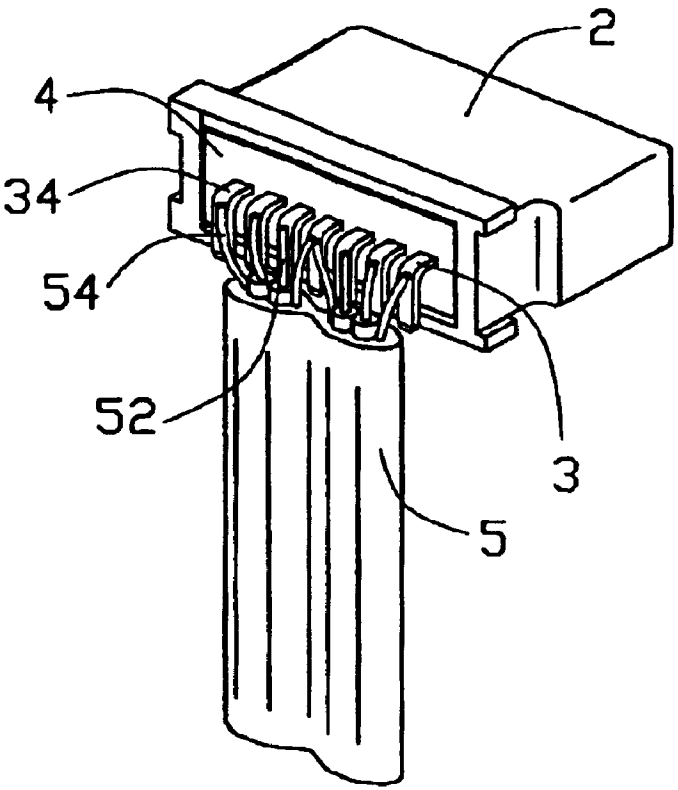
FIG. 3 is a partially assembled view of the cable connector assembly illustrating how contacts electrically connecting with conductors of a cable.

Referring to FIG. 1 and FIG. 2, a cable connector assembly 1 in accordance with the present invention comprises an insulative housing 2, a plurality of conductive contacts 3, a spacer 4, a cable 5, and a pulling mechanism including a locking member 6 and a pulling member 7.

Continuing to FIG. 1 and FIG. 2, the insulative housing 2 is substantially elongated. The insulative housing 2 comprises a mating face 20 disposed at a front end thereof along a longitudinal direction, a rear face 22 formed at a rear end of the insulative housing 2 and opposite to the mating face 20, and a pair of lateral faces 23, 24 disposed on opposite sides of the insulative housing 2 and extending between the mating face 20 and the rear face 22. A guiding member 230 projects outwardly from one lateral face 23 of the housing 2 for properly guiding insertion of a complementary connector (not shown). An L-shaped receiving space 21 extends rearwardly from the mating face 20 of the insulative housing 2. A plurality of contact passages 27 extends from the mating face 20 toward the rear face 22 and communicates with the receiving space 21. A cutout 240 is defined in the rear end of the insulative housing 2 and recesses from the other lateral face 24. A pair of ribs 25 are provided on opposite upper and lower faces (not labeled) of the insulative housing 2. Opposite ends of each rib 25 respectively extend beyond the lateral faces 23, 24. A cavity 26 is recessed from the rear face 22 of the housing 2 and communicates with the passages 27.

The conductive contact 3 comprises a retention section 32, a mating section 30 extending forwardly from the retention section 32 with a front curved contacting end 300 and a tail section 34 bending downwardly from the retention portion 34 for soldering with the cable 5.

Continuing to FIGS. 1–2, the spacer 4 is a rectangular block and defines a plurality of holes 40 therein corresponding to the conductive contacts 3.

The cable 5 comprises a pair of groups 50 enclosed by an outer jacket 58. Each group 50 comprises a pair of signal conductors 52 arranged side by side and a pair of grounding conductors 54 spaced by the pair of signal conductors 52. Each signal conductor 52 is surrounded by an insulator 56 to insulate from the grounding conductors 54.

The locking member 6 is U-shaped and comprises a main body 60 and a pair of arms 62 extending forwardly from opposite ends of the main body 60. A pair of openings 64 are respectively defined in the arms 62. In the preferred embodiment, the locking member 6 is made of metallic material.

The pulling member 7 is formed as a loop and has a pair of distal ends 70, 72.

In assembly, referring to FIGS. 1–4, the conductive contacts 3 are respectively inserted through the passages 27 with the curved contacting ends 300 thereof exposed in the receiving space 20 for electrically connecting with corresponding terminals of the complementary connector. The retention sections 32 interfere fit into corresponding passages 27 for securing the contacts 3 in the insulative housing 2. The tail sections 34 extend through the holes 40 of the spacer 4 and are exposed beyond the rear face 22 of the housing 2. The spacer 4 is received in the cavity 26 of the housing 2. The signal and the grounding conductors 52, 54 are respectively soldered with the tail sections 34 of the contacts 3 to form an electrical connection between the cable 5 and the contacts 3.

Figure 4:
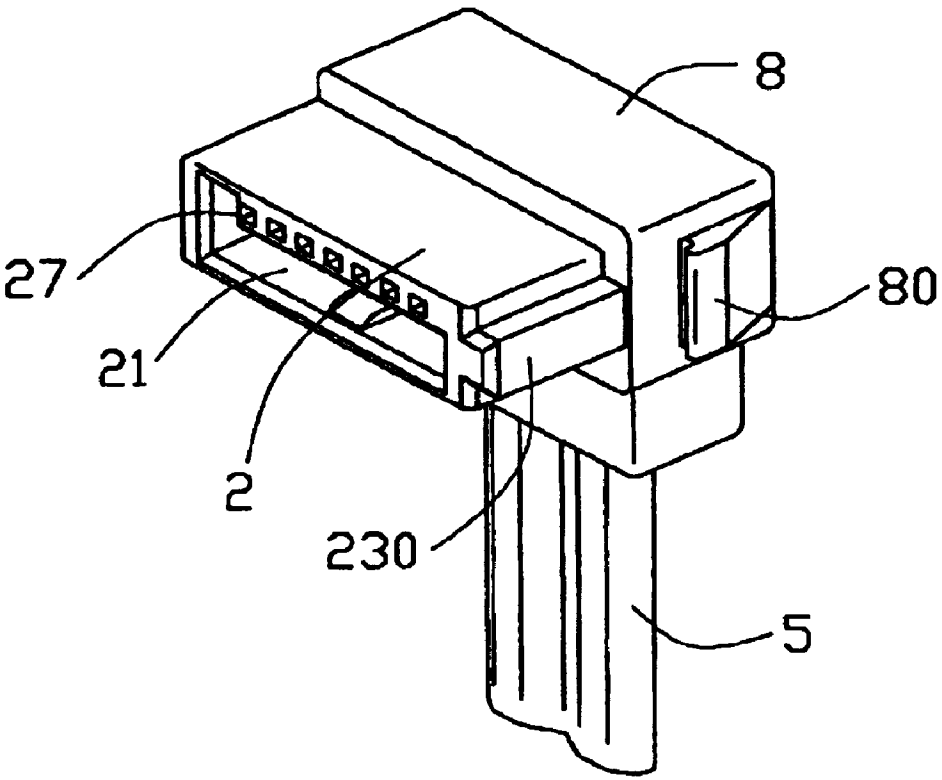
FIG. 4 is a partially assembled view of the cable connector assembly with a cover overmolded to a housing.

Particularly referring to FIG. 4, an insulative cover 8 made of dielectric moldable material is overmolded on the rear end of the insulative housing 2 and encloses the portion where the tail sections 34 of the contacts 3 and a front end of the cable 5 are connected. The insulative cover 8 functions as a strain relief to the cable 5 and protects the electrical connection between the contacts 3 and the cable 5. A pair of protrusions 80 are formed on opposite sides of the cover 8. The pair of ribs 25 of the insulative housing 2 are employed for increasing the retaining force between the housing 2 and the cover 8.

Figure 5:
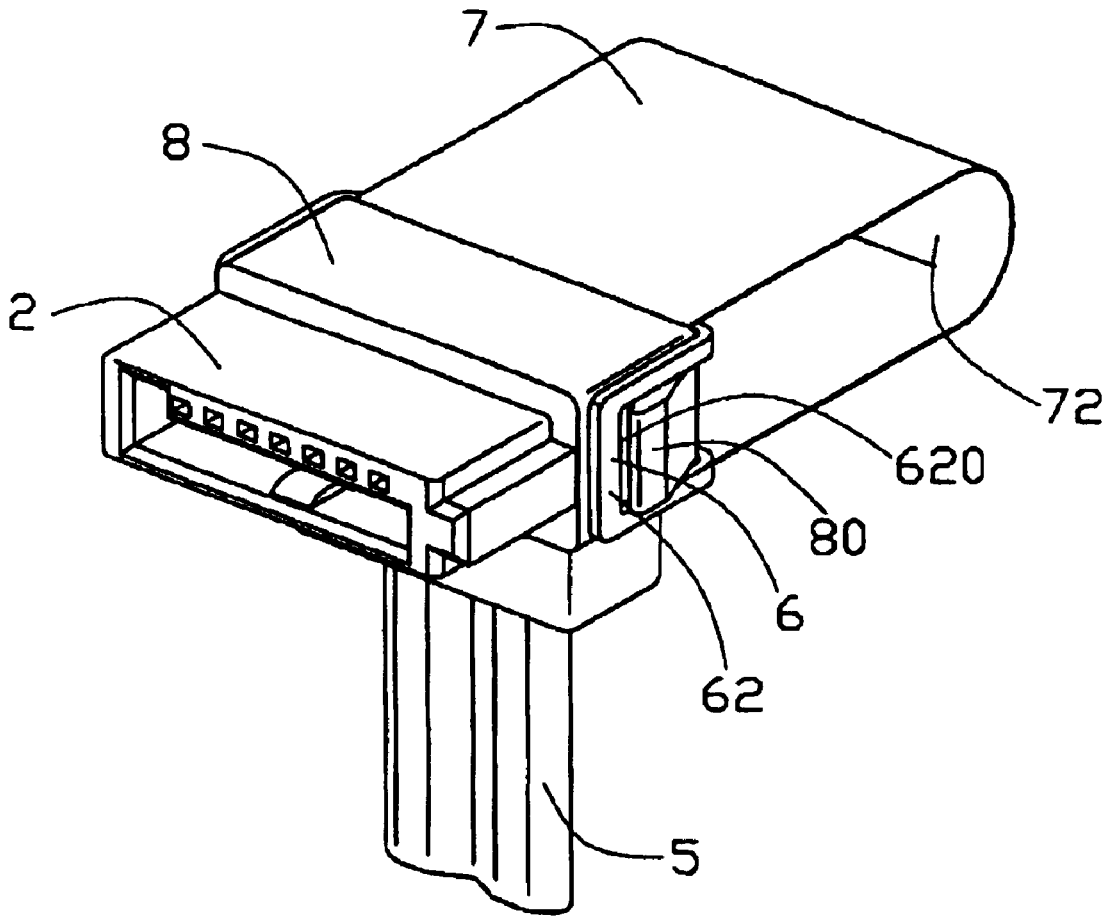
FIG. 5 is an assembled view of the cable connector assembly.
Figure 6:
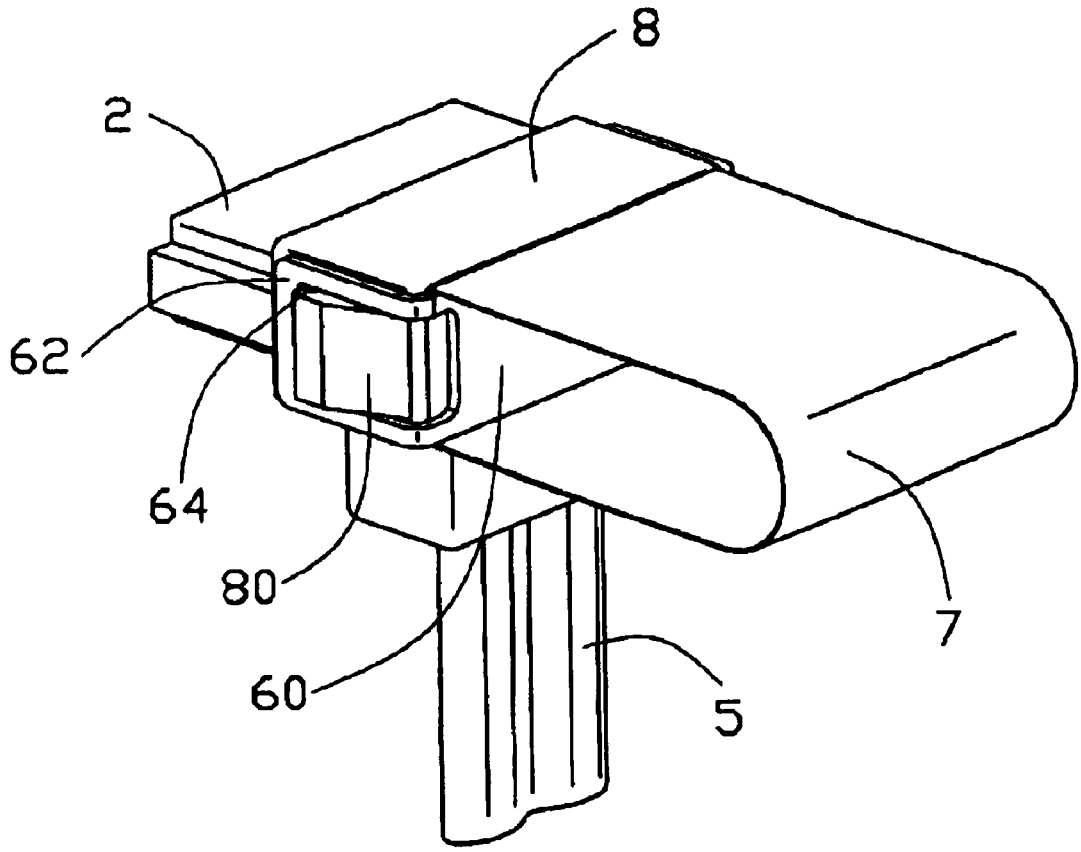
FIG. 6 is a view similar to FIG. 5, but taken from a different aspect.

Referring to FIGS. 5–6 in conjunction with FIGS. 1–2, the locking member 6 protrudes through the distal end 70 of the pulling member 7 and is assembled to the insulative cover 8. The pair of protrusions 80 of the cover 8 are respectively received in the openings 64 of the locking member 6 and abut against edges 620 of the arms 62. The main body 60 of the locking member 6 faces to a rear face (not labeled) of the cover 8 with the distal end 70 of the pulling member 7 being sandwiched therebetween.

When the cable connector assembly 1 is disengaged from the complementary connector, a user only needs to pull the other distal end 72 of the pulling member 7. It should be noted that the pulling mechanism of the present invention occupies very little space while maintains the same function as the pulling mechanism employed in the prior arts.

Figure 7:
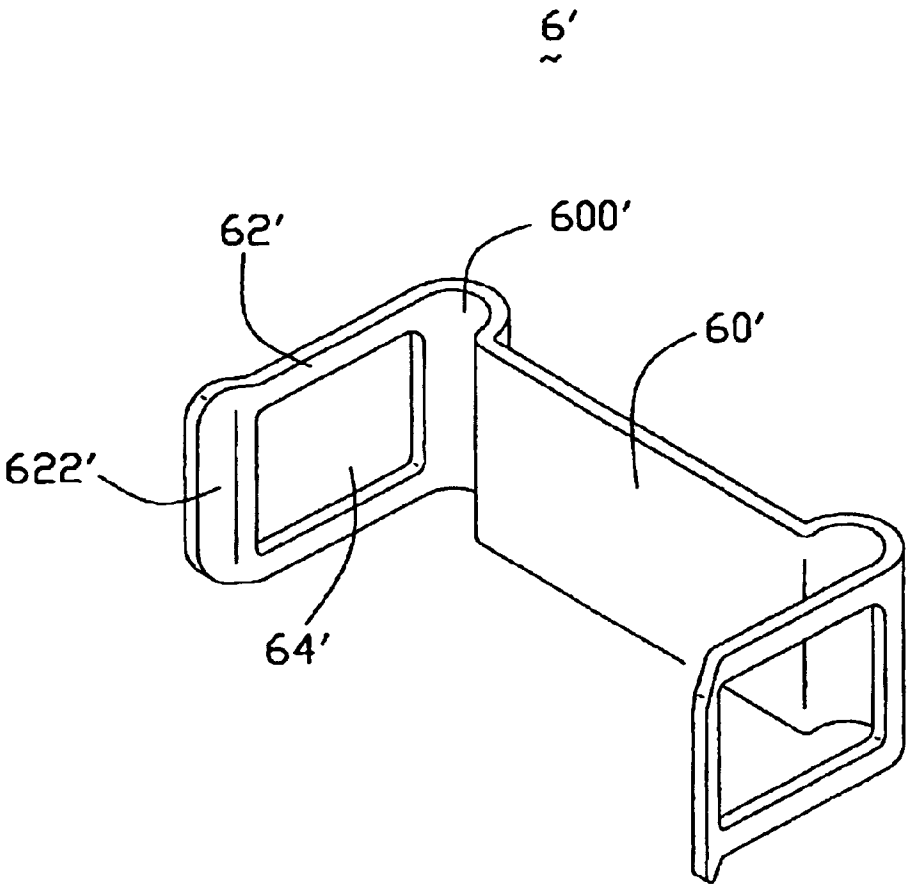
FIG. 7 is a perspective view of a locking member of the cable connector assembly in accordance with another embodiment of the present invention.

A pulling member 6' of the cable connector assembly 1 in accordance with another embodiment of the present invention is disclosed in FIG. 7. The pulling member 6' comprises a main body 60' having a pair of shoulders 600' protruded on opposite ends thereof and a pair of arms 62' respectively extending forwardly from opposite distal ends of the shoulders 600'. Each arm 62' defines an opening 64' therein and has an edge 620' for engaging with a corresponding protrusion 80 of the cover 8. A forward end 622' of each arm 62' is chamfered for assembling the pulling member 6' to the cover 8 easily.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A cable connector assembly adapted for engaging with a complementary connector, comprising:

an insulative housing comprising a mating face and a rear face opposite to the mating face and a plurality of passages extending from the mating face toward the rear face;

a plurality of conductive contacts respectively received in the passages;

a cable comprising a plurality of conductors respectively electrically connecting with the conductive contacts;

a cover partially enclosing the housing;

a locking member assembled to the cover and comprising a main body facing to the cover and a pair of arms engaging with the cover; and a pulling member having one end sandwiched between the cover and the main body of the locking member and an opposite end adapted for being pulled to disengage the cable connector assembly from the complementary connector.

2. The cable connector assembly as claimed in claim 1, wherein the pulling member is formed as a loop.

3. The cable connector assembly as claimed in claim 1, wherein the cover forms a pair of protrusions, and wherein the pair of arms of the locking member respectively engage with the protrusions of the cover.

4. The cable connector assembly as claimed in claim 1, wherein a forward end of each arm of the locking member is chamfered.

5. The cable connector assembly as claimed in claim 1, wherein the locking member is made of metallic material.

6. The cable connector assembly as claimed in claim 1, wherein the housing defines an L-shaped receiving space communicating with the passages thereof.

7. The cable connector assembly as claimed in claim 6, wherein the conductive contact comprises a mating section received in a corresponding passage and partially exposed into the receiving space for electrically connecting with the complementary connector.

8. The cable connector assembly as claimed in claim 6, wherein the conductive contact comprises a tail section extending opposite to the mating section, and wherein the conductors of the cable comprise a plurality of signal conductors and a plurality of grounding conductors respectively soldered with the tail sections of the contacts.

9. The cable connector assembly as claimed in claim 8, wherein the conductive contact comprises a retention section interconnecting the mating section and the tail section, and wherein the tail section bends vertically from the retention section.

10. The cable connector assembly as claimed in claim 8, wherein the cable comprises a pair of signal conductors arranged side by side and a pair of grounding conductors spaced by the pair of signal conductors.

11. The cable connector assembly as claimed in claim 8, further comprising a spacer, and wherein the housing defining a cavity in a rear end thereof to receive the spacer.

12. The cable connector assembly as claimed in claim 11, wherein the spacer defines a plurality of holes therein, and wherein the tail sections of the contacts respectively protrude through the holes before soldering to the conductors of the cable.

13. The cable connector assembly as claimed in claim 1, wherein the housing forms a guiding member on a lateral face thereof for properly guiding insertion of the complementary connector.

14. The cable connector assembly as claimed in claim 1, wherein the cover is made of dielectric moldable material and is overmolded to the housing and encloses the portion where the contacts and the cable are connected.

15. The cable connector assembly as claimed in claim 1, wherein the pulling member extends along a direction parallel to the passages, and the cable extends along a direction perpendicular to the passages.

16. A cable connector assembly comprising:

an insulative housing defining a front mating face and a rear mounting face opposite to each other in a front-to-back direction;

a plurality of conductive contacts disposed in the housing with tail portions exposed outside of the housing;

a cable including a plurality of conductors respectively connecting to the corresponding contacts, said cable essentially extending in a direction perpendicular to said front-to-back direction;

an insulated cover molded over at least a rear portion of the housing and covering said rear face and a front portion of the cable, said cover cooperating with the housing to commonly define an L-shape configuration thereof;

a locking member attached to the cover and vertically located above the cover; and a pulling member including at least an upper portion located above the locking member in a vertical direction for grasping.

17. The assembly as claimed in claim 15, wherein said pulling member further includes a lower portion sandwiched between the locking member and the cover.

18. The assembly as claimed in claim 15, wherein said locking member and said pulling member are discrete from each other.

* * * * *